US005758497A

United States Patent [19]

Frederiksen et al.

[11] Patent Number: 5,758,497

[45] Date of Patent: Jun. 2, 1998

[54] SILENCER

[75] Inventors: Svend Frederiksen, Lund, Sweden; Lars Frederiksen, Gentofte, Denmark

[73] Assignee: Silentor A/S, Denmark

[21] Appl. No.: 649,573

[22] Filed: May 17, 1996

[30] Foreign Application Priority Data

May 19, 1995 [WO] WIPO ..... PCT/DK95/00200

[51] Int. Cl.[6] ..... F01N 3/28

[52] U.S. Cl. ..... 60/299; 422/176

[58] Field of Search ..... 60/299; 422/176, 422/177, 180; 181/258, 272, 269

[56] References Cited

U.S. PATENT DOCUMENTS

| | | | |
|---|---|---|---|
| 2,677,231 | 5/1954 | Cornelius | 422/176 |
| 3,852,042 | 12/1974 | Wagner | 422/176 |
| 3,897,853 | 8/1975 | Frederiksen | 181/269 |
| 4,032,310 | 6/1977 | Ignoffo | 422/176 |
| 5,150,573 | 9/1992 | Maus et al. | 60/299 |
| 5,355,973 | 10/1994 | Wagner et al. | 60/299 |
| 5,426,269 | 6/1995 | Wagner et al. | 181/258 |

FOREIGN PATENT DOCUMENTS

| | | |
|---|---|---|
| 128427 | 9/1974 | Denmark . |
| 169823 | 7/1993 | Denmark . |
| 2307215 | 8/1974 | Germany . |
| 2428964 | 1/1976 | Germany . |
| 2429002 | 1/1976 | Germany . |
| 4130113 | 3/1992 | Germany . |
| 169581 | 4/1992 | Norway . |
| 94 10430 | 5/1994 | WIPO . |
| 9418438 | 8/1994 | WIPO . |

*Primary Examiner*—Sheldon Richter

*Attorney, Agent, or Firm*—Ostrolenk, Faber, Gerb & Soffen, LLP

[57] ABSTRACT

An apparatus for silencing and catalytic treatment of gases has an air-tight casing connected to an exhaust inlet pipe and to an exhaust outlet pipe, acoustic compartments, monolithic bodies, and a diffuser element. The diffuser element is connected to the inlet pipe, or further downstream within the casing. The diffuser element distributes the gases evenly across the inlet face of the monolithic bodies. The diffuser element is a guide baffle or plate and a juxtaposed stagnation baffle or plate, which causes both flow stagnation in front of the stagnation plate and the gases to flow radially within the diffuser element. The diffuser element has apertures which are pervaded by partial flows of the gas and are adapted to provide additional recovery in the gas flow passing through the diffuser element. The geometry defining the fluid flow field within the diffuser is designed to prevent flow separation from the contour walls of the diffuser.

14 Claims, 4 Drawing Sheets

1
2
3
4
5
6
7
8
9
10
11
13
14

5
11
12f
15
16
17

5
8
7
19
4
12af 11
10
SEE FIG. 5
12f
4, 13

10
12a
12a
13

4
14
14
20
12af
13
4
11
10
7
9
SEE FIG. 7
6
5
6
1
8
2

10
12f
9
8
5
6

SILENCER

DESCRIPTION OF THE INVENTION

The present invention discloses a silencer with a built-in catalyser which utilises a given total space optimally for simultaneous silencing and conversion of noxius exhaust gases, typically exhaust gases from prime mover internal combustion engines. The invention can also be applied to stationary engines with compact exhaust systems.

The invention provides a diffuser of the type which recovers dynamic pressure, and which can be adopted, both for sound attenuation and for even distribution of exhaust gases to a multitude of channels, distributed over the inlet cross-section of a monolithic body.

As a consequence of ever more stringent environmental regulations, demands for low exhaust noise levels and for low levels of particle and noxius gas emissions to the atmosphere are increasing all the time. In addition, it is required that silencers and catalysers do not cause excessive pressure losses, since a high back-pressure to the engine retracts from performance and increases fuel consumption. This poses a problem to the exhaust system designer, since the available under-vehicle space is restricted.

A first step towards space economy, which has been adopted already, is to combine silencers and catalysers by inserting a catalyser inside the casing of a silencer. Even a simple catalyser containing canister causes some noise attenuation, by virtue of its acoustic volume or by throttling of the exhaust flow. In the case of a catalytic body with uninterrupted, straight channels of low pressure drop, however, the attenuation effect of the catalyser as such is only marginal, which can be shown by removing the catalytic body and by measuring how this influences the exhaust noise level outside the exhaust pipe system. Wall-flow catalysers, in which gases are forced along follow tortuous pathways inside the catalyser body, are more effective in suppressing noise, but such devices also cause rather high pressure drops.

In diesel engine exhaust systems accumulation of particulate matter is sometimes a problem. In catalysers particulate matter which is not converted tends to hamper the conversion process and to cause increased pressure drop, and may even block the catalyser after some service time. This problem calls for careful fluid dynamic design, both of catalytic units as such, and of silencer/catalyser assemblies.

Various sorts of diffusers have been utilised as flow distribution arrangements in front of catalysers and as flow elements in silencers.

In the first case these arrangements are answers to the following problem: Supposing that a catalyser is positioned close to an inlet pipe of a substantially smaller diameter, how can an even flow distribution across the diameter of the catalyser be achieved? The short distance is a frequent design condition which results from requirements for compact solutions.

A convenient solution is to fit a perforated baffle in the space between the inlet pipe and the catalyser to create a flow resistance which evens out the flow across the inlet diameter to the catalyser. One drawback with this type of solution is that it creates increased pressure losses. Another problem is that perforations may create flow-induced, secondary noise.

Many types of diffusers have been suggested as less dissipative solutions to the flow distribution problem. Examples of this are: German Offenlegungsscbrift no. 24 28 966, which describes a pure flow line diffuser, and German Offenlegungsschrift no. 24 29 002, which describes arrangements with a plurality of flow dividing cones. The latter type of solution resembles well-known arrangements incorporating guide vanes in front of steam boiler exhaust catalysers, as well as 'splitter' type diffusers commonly used in ventilating ductwork. German Offenlegungsschrift no. 24 28 964 and Norwegian utlegningsskrift no. 169581 both disclose more original diffuser/catalyser arrangements.

A particularly simple and compact arrangement is known from German Offerlegungsschrif no. 2 307 215 in which a perforated, conical member is inserted into a conical end cap at the inlet to a catalyser. This arrangement divides the rather small cavity in front of the catalyser into a flow distributing first cavity with diffuser properties and a second, flow mixing cavity immediately in front of the catalyser.

While several of these diffuser arrangements may be effective in creating compact solutions to the catalyser flow distribution problem, they do not take acoustic aspects into consideration. Thus, an inherent acoustic problem associated with pure diffuser/catalyser arrangements is that the inflow to the compartment incorporating the catalyser is located at an end wall. Here, pressure amplitudes associated with resonance gas vibrations are at a maximum and are therefore exited maximally. The most problematic resonance is the lowest, whose wave length is twice the length of the compartment.

Incorporation of radial diffusers in silencers is known from Danish patent no. 128427, which describes how such elements can be utilised for the purpose of suppressing acoustic resonances by locating the diffuser outlet in the pressure node at the center of the compartment, halfway between baffles.

Danish patent no. 169823 discloses how special type diffusers with a narrow, axial outflow into an acoustic compartment can be adopted for suppressing lateral, resonant gas vibrations, in particular in the case of silencers of large diameter compared to pipe diameters. This patent also mentions the possibility of utilising a radial flow property of axial outflow diffusers to obtain a flow distribution effect in front of a catalyser inserted into the silencer. However, due to the narrow lateral extension of the diffuser outflow, such a diffuser only solves the flow distribution problem to some extent. To obtain full distribution at the inflow to the catalyser, a certain distance between the diffuser outlet and the catalyser is required.

In the present invention, a novel type of diffuser solves the catalyser flow distribution problem effectively within a short, axial distance and in a way which promotes noise attenuation.

This novel type of flow element is termed a multiple-double diffuser to characterise its geometry. In short, it can be described as a combination of a radial diffuser and a multitude of parallel, small width channels which can act as diffusers in themselves. In most cases, the multiple-double diffuser communicates with an adjacent acoustic cavity to which acoustic energy is transmitted.

The general object of this invention is to provide an apparatus for silencing and catalytic treatment of gases, comprising: an air-tight casing connected to an exhaust inlet pipe and to an exhaust outlet pipe, one or more acoustic compartments, one or more monolithic bodies, and a diffuser element connected to the inlet pipe or to a further pipe or channel within the casing, from which diffuser element flowing gases are distributed evenly across the inlet face of one of the monolithic bodies, wherein the diffuser element comprises a guide baffle or plate and a juxtaposed stagnation baffle or plate causing full or partial flow stagnation in front of the stagnation plate and causing the gases to flow radially within the diffuser element, that the diffuser element has at least 2 apertures of which at least 2 apertures are pervaded by partial flows of the gas and are adapted to provide additional pressure recovery in the gas flow passing through the diffuser element, and that the geometry defining the fluid flow field within the diffuser is designed to prevent flow separation from the contour walls of the diffuser.

BRIEF DESCRIPTION OF THE DRAWINGS

In the following detailed description of the invention, FIGS. 1 and 2 show an embodiment of the invention. Here, a catalyser 5 is fitted into a casing 1, into which unsilenced and uncleaned exhaust gases are led by an inlet pipe 2, and from which silenced and cleaned gases are led out again by an outlet pipe 3. An elastic and high-temperature resistant layer 6 holds the catalyser and protects it from undue mechanical forces. An acoustic compartment 4 is arranged in front of the catalyser. The inlet pipe extends via an internal pipe 8 through this compartment to a multiple-double diffuser 7. In this element part of the dynamic pressure of the oncoming gases is recovered, the flow is distributed evenly across the face 9 of the catalyser 5, and acoustic energy is transmitted into the compartment 4, where part of this energy is absorbed by the dynamic effect of the cavity and by the dissipative effect of sound absorption material 13, preferably a long-fibre mineral wool, which is mechanically sufficiently strong and temperature resistant. A perforated pipe 14 holds the sound absorbing material and allows for acoustic energy to be transmitted into the material.

Figure 2:
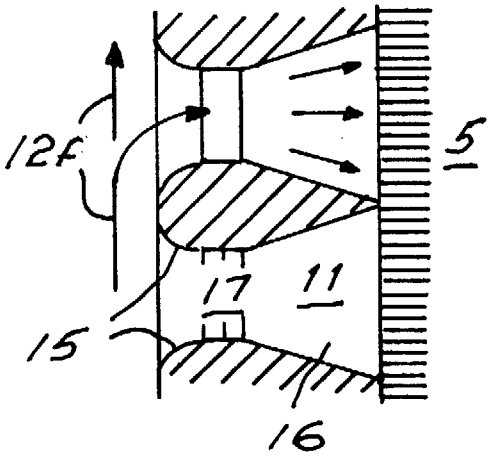
FIG. 2 is an enlarged fragmentary view of a portion of the apparatus shown in FIG. 1.

The diffuser 7 is made up of a guide baffle 10 and a cross-plate flange 11, which causes partial flow stagnation, and which leads the flow further to the catalyser by a multitude of apertures 12*f*, which are shown in detail in FIG. 2. At the aperture inlets, a curvature 15 is provided for, in order that local flow separation and vena contracta phenomena be avoided. The lengths of the apertures are significant in relation to their lateral dimensions. This makes possible aperture geometries which incorporate divergences in the latter part 16 of the apertures.

At the periphery of the guide baffle 10, an aperture 12*af* of the diffuser allows for flow to pass on to the outer apertures 12*f* of the cross-plate flange 11 and provides an opening to the acoustic compartment 4. Here, as in later figures, an 'a' attached to the number 12 indicates that the aperture in point serves the fimction of providing communication to an acoustic compartment, whereas an attached 'f' indicates that a flow passes through the aperture.

The multiple-double diffuser can be simply described as a 2-stage diffuser. In the first, radial stage, the flow partly stagnates, partly changes direction into a radial flow, and is roughly distributed across the diameter of the catalyser. In the second diffuser stage, the multitude of small diffusers cause a further flow distribution, which is much smaller in terms of lateral displacement, but which is nevertheless substantial in terms of total flow area increase. In both diffuser stages, pressure recovery takes place, i.e. the flow velocity decreases in the general flow direction and dynamic pressure is converted into static pressure, so that there is an increase in static pressure.

The 2-staged pressure recovery is favourable in that it prevents flow separation, a phenomenon which may occur in diffusers with a too big widening of flow area. Flow separation can be described as a boundary layer phenomenon associated with frictional forces between contour walls and bulk fluid flow. Due to the flow resistance of walls guiding a fluid, flow layers immediately adjacent to the walls are slowed down. If the slowing down process takes a progressive course, flow reversal, causing separation and vortices, may occur at some downstream point along the wall. For a given diffuser, the risk of flow separation increases if the diffuser is preceded by a straight pipe, compared to the case of flow entering the diffuser from a big cavity. The reason is that in the first case the slow down effect in the boundary layer has started already upstream of the diffuser entrance. In the multiple-double diffuser, the slow down effect is interrupted in the middle of the diffuser by the 2-stage composition, i.e., each of the parallel channels of the 2nd stage does not 'inherit' any boundary layer slow down effect from the inlet pipe.

Thus, the multiple-double diffuser is extremely effective as a flow-distribution and pressure recovery element. The geometry of the diffuser can be modified in many ways to optimise the finction according to various demands. As an example, the sizes of the apertures can vary with their radius relative to the silencer centre axis, to achieve almost identical outflow velocties from all apertures.

Figure 1:
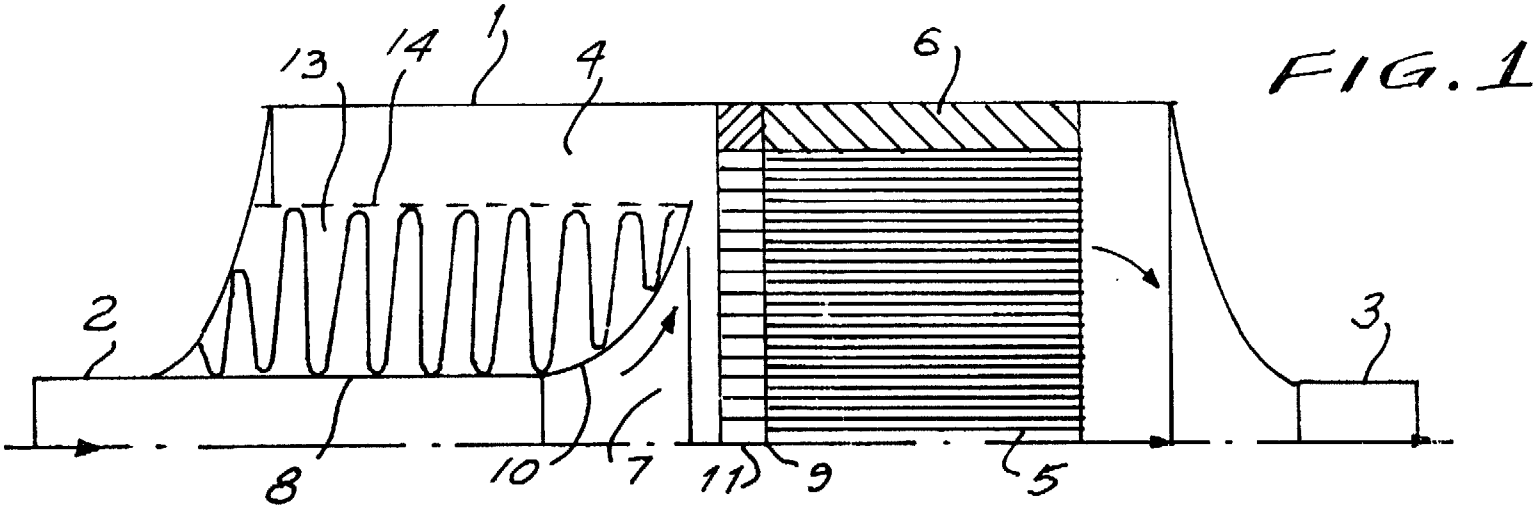
FIG. 1 is a cross-sectional view of an apparatus for silencing and catalytic treatment of exhaust gases according to a first embodiment of the invention.

In the embodiment of the invention shown in FIGS. 1 and 2 the apertures can be designed to have the forms of peripheral slots. Thus, the flow leaving the multitude of apertures will fill the entire cross section between the center and the outer periphery of the catalyser inlet face 9. In that case no distance is provided for between the diffuser and the catalyser in order that part flows enter practically all the multitude of parallel channels of the catalyser.

The separation preventing form of the multiple-double diffuser has the additional advantage of preventing local accumulation of particulate matter in recirculation zones. The risk of this unwelcome phenomenon can be further minimised by providing catalytic layers onto the inner walls ofthe apertures 12.

The cross-plate flange 11 can be manufactured from cast iron. As an alternative, the cross-plate can be manufactured as a part of the catalyser in cases when catalysers are fabricated in a way which permits rather wide form variations, as can e.g. be achieved with metallic foil substrates. A further option is to create the flow area variation of the apertures by composing the cross-plate of a layer of perforated plates with different sizes of the perforations of each plate.

Figure 3:
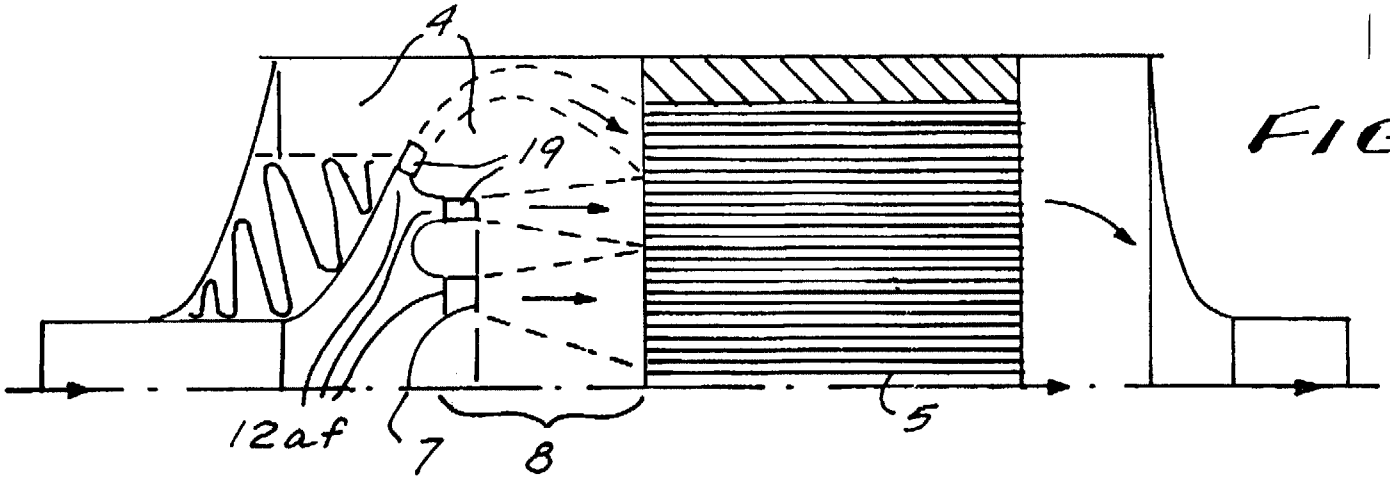
FIG. 3 is a cross-sectional view of a second embodiment of the invention.

FIG. 3 shows a second embodiment of the invention, in which the number of apertures is much smaller than in the first embodiment, and in which there is a distance 18 between the diffuser 7 and the catalyser 5. The bigger flow areas of the multitude of apertures in this case in a simple way help prevent blockage due to accumulation of particulate matter. The geometric form indicated in FIG. 3 also differs from the previously shown form in that there is no flow area increase in the apertures. Still, the diffuser is an extremely effective flow distributive and pressure recovery element, due to its overall favourable flow geometry, incorporating interruption of boundary layer slow down. Classes of favourable diffuser geometries, resembling that of FIG. 3, can be generated from the theory of 3-dimensional, axisymmetrial potential field theory. In the embodiment of FIG. 3, the cross-plate 11 can most simply be fabricated from press formed steel sheets which are welded together with ribs 19, which are axially aligned with the flow direction.

The acoustically most favourable position of the diffuser outlet depends on a number of factors, including the acoustic properties of the catalyser. If the catalyser only represents a minor acoustic disturbance in the compartment in which it is situated, a diffuser outlet position at the centre between the end walls of the compartment will most effectively suppress axial resonances with a pressure node at the centre, including the lowest order resonance. In case the catalyser instead represents an effective flow area reduction and thus an acoustic disturbance, a diffuser outlet position at some distance from the center, as e.g. indicated in FIG. 3, may be acoustically better. Such optimisations require systematic experiments or detailed acoustic calculations.

Figure 4:
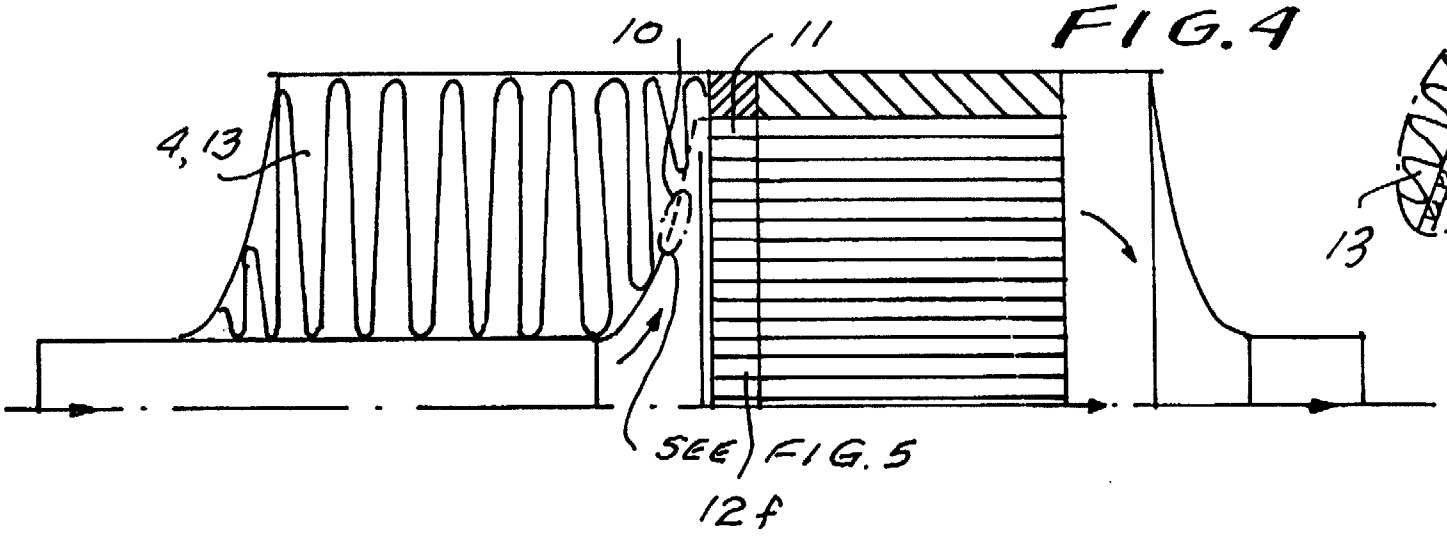
FIG. 4 is a cross-sectional view of a third embodiment of the invention.
Figure 5:
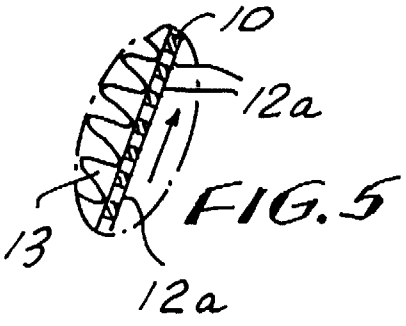
FIG. 5 is an enlarged fragmentary view of a portion of the apparatus shown in FIG. 4.

FIGS. 4 and 5 show a third embodiment according to the invention in which some of the apertures 12*a* of the diffuser 7 are perforations which are not pervaded by flow, but serve the finction of providing acoustical openings to sound absorption material 13 within the acoustical compartment 4 between the first end cap of the casing and the guide baffle 10.

Figure 6:
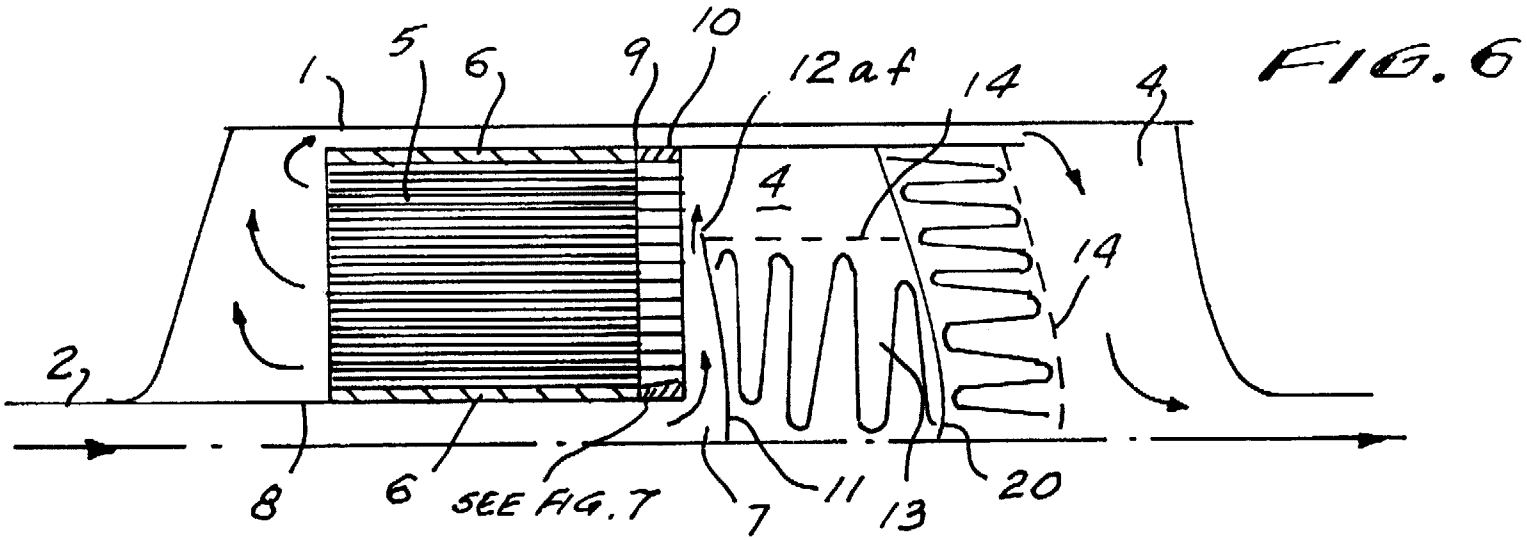
FIG. 6 is a cross-sectional view of a fourth embodiment of the invention.
Figure 7:
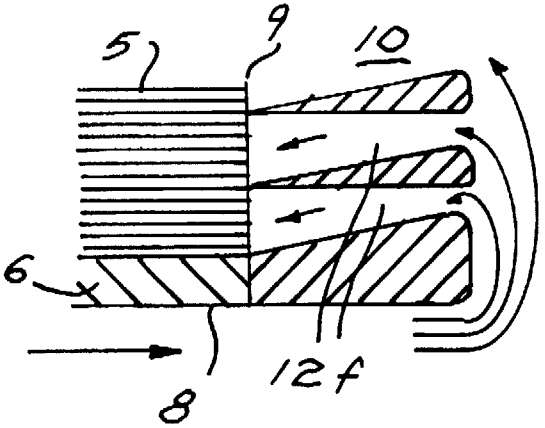
FIG. 7 is an enlarged fragmentary view of a portion of the apparatus shown in FIG. 6.

FIGS. 6 and 7 show a fourth embodiment of the invention in which the multiple-double diffuser 7 has been utilised for a double reversal of the flow through a silencer/catalyser to create an assembly with two acoustic compartments. In this embodiment the apertures 12*f* distributing the flow to the catalyser are placed within the guide plate 10 connected to the onflow pipe 8, whereas the cross baffle 11 is a full plate. An opening 12*af* at the periphery of this plate allows for flow to pass on to the outer apertures 12*f* of the guide plate, and provides an opening which permits acoustic energy to be transmitted into the acoustic compartment 4.

The flow reversal, which takes place in the multiple-double diffuser, is performed within a very short distance in the axial direction. For a given distance between the inlet face 9 of the catalyser and the baffle 20 this maximises the distance between the diffuser outlet and the baffle 20. Thereby the tendency for acoustic resonanses to be exited can be kept at a minimum, since pressure maxima are present at the baffle and would therefore have been exited if instead the inlet to the compartment had been positioned close to the baffle.

FIG. 7 indicates a further feature of the reversed multiple-double diffuser: The general flow direction of the apertures close to the silencer centre axis has been tilted, so that for flows in these apertures the total flow reversal in the multiple-double diffuser somewhat exceeds 180 degrees. Thereby the turning radii of the part flows to those apertures need not be too small, which prevents flow separation. At the same time, flow can be fed to catalyser channels close to the catalyser penetrating pipe 8, so that the cross section between this pipe and the outer, annular channel can be utilised maximally.

Figure 8:
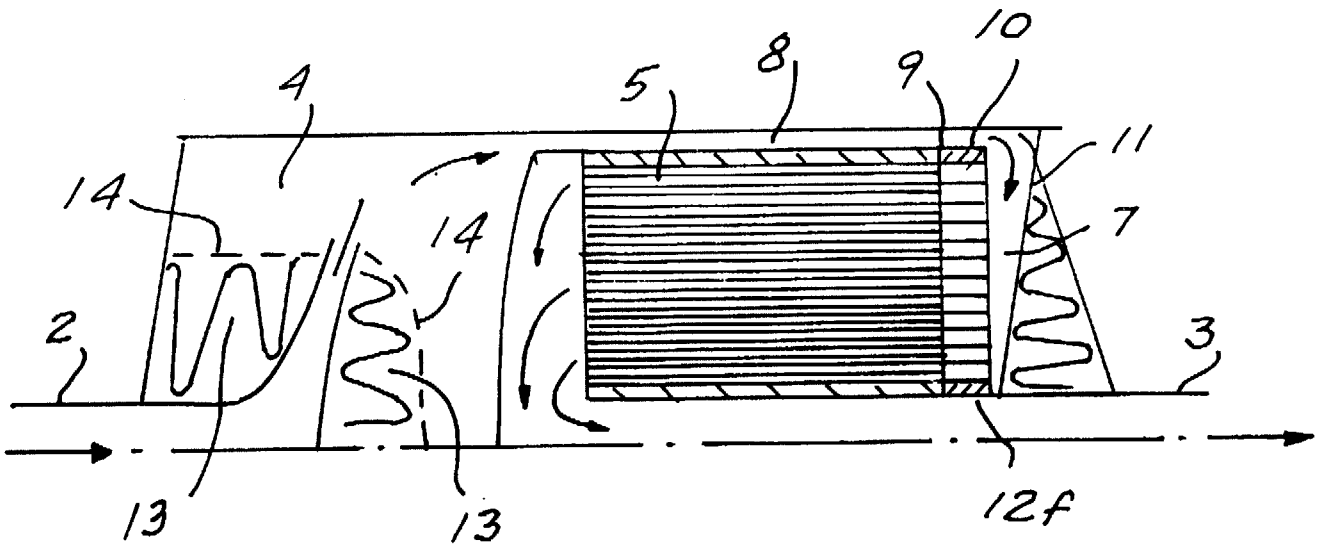
FIG. 8 is a cross-sectional view of a fifth embodiment of the invention.

FIG. 8 shows a fifth embodiment of the invention in which an internal, annular channel 8 inside a silencer casing feeds flow to a reversing multiple-double diffuser in which radial flow is directed towards the centre of the silencer, instead of outwardly, as in the previously shown embodiments. Another distinction is that the channel 8 feeding the diffuser 7 is not directly connected to the inlet pipe 2; instead, the exhaust gas flow passes an acoustic compartment 4 prior to entering the channel 8. A last distinctive feature of the embodiment of FIG. 8 is that the only apertures of multiple-double diffuser are those apertures 12*f* which guide flow onto the catalyser; no further apertures providing openings to an acoustic compartment have been provided for. This, admittably, will tend to promote exitation of gas vibration resonanses in the catalyser. On the other hand, the very compact catalyser compartment allows the acoustic compartment 4 to be of maximal size, for a given total size of the casing and a given size of the catalyser. Whether this acoustical trade-off is benefical or not will depend on the detailed acoustic properties of the unit and on exactly which attenuation spectrum is called for in a given application to an engine.

We claim:

1. An apparatus for silencing and catalytic treatment of gases comprising:

an air-tight casing (1) connected to an exhaust inlet pipe (2) and to an exhaust outlet pipe (3), one or more acoustic compartments (4), one or more monolithic bodies (5), and a diffuser element (7) connected to the inlet pipe (2) or to a further pipe or channel (8) within the casing, from which diffuser element flowing gases are distributed evenly across the inlet face (9) of one of the monolithic bodies, wherein the diffuser element (7) comprises a guide baffle or plate (10) and a juxtaposed stagnation baffle or plate (11) causing full or partial flow stagnation in front of the stagnation plate and causing the gases to flow radially within the diffuser element, the diffuser element (7) has at least 2 apertures (12) of which at least 2 apertures (12*f*) are pervaded by partial flows of the gas and are adapted to provide additional pressure recovery in the gas flow passing through the diffuser element (7), and the geometry defining the fluid flow field within the diffuser (7) is designed to prevent flow separation from the contour walls of the diffuser.

2. The apparatus according to claim 1, wherein the axial flow direction through the diffuser element (7) is the same as in the pipe or channel (2, 8) leading flow to the diffuser, and that the stagnation baffle of plate (11) contains apertures (12*f*) pervaded by flow.

3. The apparatus according to claim 1, wherein the total outflow area of the diffuser (7) exceeds the inflow area of the diffuser, and that there is an increase of static pressure from the inlet of the diffuser to the outlets of the diffuser.

4. The apparatus according to claim 1, wherein one or more of the flow pervaded apertures (12*f*) contains a flow area diverging portion (16).

5. The apparatus according to claim 1, wherein surfaces of flow pervaded apertures (12 *f*) of the diffuser (7) are coated by a catalytic layer (17).

6. The apparatus according to claim 1, wherein flows leaving apertures (12 *f*) of the diffuser (7) pass on directly into the monolithic body (5).

7. The apparatus according to claim 1, wherein flows leaving apertures (12 *f*) of the diffuser (7) pass an acoustic compartment (4) before entering the monolithic body (5).

8. The apparatus according to claim 1, wherein an annular channel (8) leads gas to the diffuser (7).

9. The apparatus according to claim 1, wherein 2 or more pipes or channels lead parallel flows to the diffuser (7).

10. The apparatus according to claim 1, wherein the monolithic bodies are provided with a catalytic active surface being active in the decomposition of impurities in the gases.

11. The apparatus according to claim 1, wherein the main axial flow direction through the diffuser element (7) is reversed, and that the guide baffle or plate (10) contains apertures (12*f*) pervaded by flow.

12. The apparatus according to claim 11, wherein a pipe (8) leads gas centrally through the monolithic body (5) before entering the diffuser (7).

13. The apparatus according to claim 1, wherein at least one of the apertures (12*a*) communicates with an acoustic compartment (4).

14. The apparatus according to claim 13, wherein apertures (12*a*) of the diffuser (7) communicate with sound absorption material (13) placed in an acoustic compartment (4) and are perforations of the guide baffle or plate (10) or of the stagnation baffle or plate (11), or of both baffles or plates.

* * * * *